US011503894B2

(12) United States Patent
McGrath

(10) Patent No.: US 11,503,894 B2
(45) Date of Patent: Nov. 22, 2022

(54) FLIP-LID MIRROR COSMETIC-PRODUCT PACKAGING AND METHOD OF MANUFACTURE THEREOF

(71) Applicant: Pat McGrath Cosmetics LLC, New York, NY (US)

(72) Inventor: Patricia McGrath, New York, NY (US)

(73) Assignee: Pat McGrath Cosmetics LLC, New York, NY (US)

( * ) Notice: Subject to any disclaimer, the term of this patent is extended or adjusted under 35 U.S.C. 154(b) by 627 days.

(21) Appl. No.: 16/163,078

(22) Filed: Oct. 17, 2018

(65) Prior Publication Data

US 2020/0121054 A1 Apr. 23, 2020

(51) Int. Cl.
*A45D 33/00* (2006.01)
*A45D 33/18* (2006.01)
(Continued)

(52) U.S. Cl.
CPC ..... *A45D 33/008* (2013.01); *A45D 33/18* (2013.01); *A45D 40/24* (2013.01); *A45D 40/222* (2013.01)

(58) Field of Classification Search
CPC ..... A45C 2007/0004; B65D 27/24; A45D 40/222; A45D 40/24; A45D 33/008; A45D 33/18; A45D 2040/226
(Continued)

(56) References Cited

U.S. PATENT DOCUMENTS 1,306,378 A * 6/1919 Hogan ..... B65D 27/24 229/77
1,445,298 A * 2/1923 Curnanfrankw ..... B65D 27/24 229/78.2
(Continued)

FOREIGN PATENT DOCUMENTS

CN 207653766 U 7/2018
GB 2578149 A 4/2020
(Continued)

OTHER PUBLICATIONS

Intellectual Property Office, Search Report under Section 17(5), Application No. GB1817016.7, dated Mar. 27, 2019, 3 pages.
(Continued)

*Primary Examiner* — Nicholas D Lucchesi
*Assistant Examiner* — Jennifer Gill
(74) *Attorney, Agent, or Firm* — Ziegler IP Law Group, LLC

(57) ABSTRACT

Disclosed is a flip-lid mirror cosmetic-product packaging and method of manufacture thereof. The flip-lid mirror cosmetic-product packaging includes a base unit, a half lid, and a mirror lid. The base unit includes a tray having plurality of cosmetic products. The base unit has a first elongate side and a second elongate side. The half lid is pivotally attached to the first elongate side with an accommodation gap. The mirror lid is pivotally attached to an upper edge of the second elongate side. Furthermore, an edge of mirror lid abuts to the second elongate side, to maintain mirror lid in a tilted pivotal angle when mirror lid is in an open state. The mirror lid in its closed state lies adjacent to the tray, and is accommodated within the accommodation gap, so that the half lid in its closed state overlays an externally-facing surface of mirror lid in its closed state.

11 Claims, 5 Drawing Sheets

(51) Int. Cl.
*A45D 40/24* (2006.01)
*A45D 40/22* (2006.01)

(58) Field of Classification Search
USPC ..... D9/420
See application file for complete search history.

(56) References Cited

U.S. PATENT DOCUMENTS

| | | | | |
|---|---|---|---|---|
| 2,283,815 | A * | 5/1942 | Levine | B65D 27/24 229/78.2 |
| 5,135,012 | A * | 8/1992 | Kamen | A45C 13/02 132/294 |
| 7,273,148 | B2 * | 9/2007 | Perry | B65D 85/20 206/750 |
| 10,327,527 | B1 * | 6/2019 | Tyson | A45C 13/103 |
| D905,549 | S * | 12/2020 | McGrath | D9/432 |
| 2003/0010351 | A1 * | 1/2003 | de Laforcade | A45D 40/222 132/294 |
| 2013/0104927 | A1 | 5/2013 | Hurst | |
| 2014/0190510 | A1 * | 7/2014 | Randall | A45C 5/005 132/288 |
| 2016/0183654 | A1 * | 6/2016 | Leuty | A45C 5/02 362/156 |
| 2016/0198819 | A1 * | 7/2016 | Grund | A45C 5/005 132/288 |
| 2017/0112261 | A1 * | 4/2017 | Grund | A45D 40/222 |
| 2018/0263361 | A1 * | 9/2018 | Langdon | A45D 40/24 |

FOREIGN PATENT DOCUMENTS

| | | | |
|---|---|---|---|
| JP | S59-98809 | U | 7/1984 |
| JP | H11-220 | A | 1/1999 |
| JP | 2015-29796 | A | 2/2015 |
| WO | 2020/079626 | A1 | 4/2020 |

OTHER PUBLICATIONS

Notification of Transmittal of The International Search Report and The Written Opinion of The International Searching Authority, or The Declaration, Application No. PCT/IB2019/058849, dated Feb. 13, 2020, 15 pages.

Notification Concerning Transmittal of International Preliminary Report on Patentability, Application No. PCT/IB2019/058849, dated Apr. 29, 2021, 10 pages.

"An Opulence Experience—Pat Mcgrath Labs MTHRSHP Sublime Bronze Ambition—fromSandyxo", XP055649689, Sep. 2, 2018, [retrieved on Jun. 3, 2021], 5 pages. Available at: http://fromsandyxo.com/2018/08/18/an-opulence-experience-pat-megrath-labs-mthrshp-sublime-bronze-ambition/.

James, Danielle, "Pat McGrath Seals Investment Deal With Eurazeo Brands | HelloBeautiful", XP055649821, Jul. 17, 2018, [retrieved on Jun. 3, 2021], 8 pages. Available at: https://web.archive.org/web/20180726081204/https://hellobeautiful.com/3007562/pat-mcgrath-labs/.

* cited by examiner

FLIP-LID MIRROR COSMETIC-PRODUCT PACKAGING AND METHOD OF MANUFACTURE THEREOF

TECHNICAL FIELD

The present disclosure relates generally to product packaging, and more specifically to flip-lid mirror cosmetic-product packaging that protects cosmetics products during transport, presentation for sale and eventual assistance with use of the cosmetics products by users. Moreover, the present disclosure relates to methods of (for) manufacturing aforesaid flip-lid cosmetic-product packaging.

BACKGROUND

Generally, a product packaging provides protection to a given product against degradation during storage, shipping and handling. Moreover, the product packaging contributes to an aesthetic appearance of the given product and an appeal of buying the given product. Typically, glass, plastics materials and metals are used for fabricating cosmetic product packaging. A recent trend shows an increased use of plastics materials for packaging cosmetic products. However, users usually discard the packaging of the cosmetic products, wherein packaging is generally plastic based. Such discarded plastics-materials-based waste results in plastics-material microparticles and nanoparticles in rivers and oceans, causing water pollution.

Moreover, the conventional cosmetic product packaging, which is generally in a form of a plastics-material case, is has multiple problems associated therewith. For example, when opening and closing a given conventional cosmetic product packaging (such as a case) requires a pre-determined pressure which may lead to improper or incomplete closure of the case which in turn may lead to contamination or spoilage (such as drying, hardening or cracking) of the cosmetic product stored therein. Furthermore, the frequent opening and closing of the case with pressure may also result in failure of a locking mechanism used therein. Moreover, the locking mechanisms used in the conventional cosmetic product packaging are not discrete, and often creates sounds when in operation that can be irritating at times to users.

Therefore, in light of the foregoing discussion, there exists a need to overcome the aforementioned drawbacks associated with the conventional cosmetic product packaging.

SUMMARY

The present disclosure seeks to provide an improved flip-lid mirror cosmetic-product packaging. Moreover, the present disclosure seeks to provide at least a partial solution to an existing technical problem of improper waste management of packaging of cosmetic products. An aim of the present disclosure is to provide a solution that at least partially overcomes the aforesaid problems encountered in known art.

In one aspect, there is provided a flip-lid mirror cosmetic-product packaging, wherein the flip-lid mirror cosmetic-product packaging includes:

(i) a base unit including a tray having a plurality of types of cosmetics products disposed spatially in an array on the tray, the base unit having a first elongate side and a second elongate side on mutually opposite sides of the base unit;

(ii) a half lid that is pivotally attached to the first elongate side with an accommodation gap;

(iii) a mirror lid that is pivotally attached to an upper edge of the second elongate side, wherein an edge of the mirror lid abuts to the second elongate side, to maintain the mirror lid in a tilted pivotal angle when the mirror lid is in an open state; and (iv) the mirror lid in its closed state lies adjacent to the tray, and is accommodated within the accommodation gap, so that the half lid in its closed state overlays an externally-facing surface of the mirror lid in its closed state.

The embodiments of the present disclosure substantially eliminate, or at least partially address, the aforementioned problems in the prior art and allows for a given user to be provided with an environment-friendly cosmetic-product packaging.

The present disclosure provides for a substantial reduction in wastage of resources used in manufacturing the cosmetic-product packaging. Additionally, the present disclosure provides the cosmetic-product packaging that is reusable and recyclable.

Optionally, an externally-facing surface of the half lid is provided with a first stud having a first flange with cord or cord loop attached thereto, and the externally-facing surface of the mirror lid is provided with a second stud having a second flange for receiving the cord or cord loop to maintain the half lid and the mirror lid secured together when the flip-lid mirror cosmetic-product packaging is to be maintained in a closed state.

Optionally, the flanges of the first and second studs have a diameter in a range of 10 mm to 25 mm.

Optionally, the flanges are secured to the half lid and the mirror lid by employing hollow metallic rivets.

Optionally, the half lid and the mirror lid are provided with a permanent magnet arrangement to assist to maintain the half lid retained adjacent to the mirror lid when the flip-lid mirror cosmetic-product packaging is to be maintained in a closed state.

Optionally, the permanent magnet arrangement includes a magnet arranged with the half lid, and wherein the mirror lid includes a ferrous sheet of metal magnetically attracted to the magnet in the half lid.

Optionally, an inside surface of the mirror lid is provided with a mirror with a surrounding margin to retain the mirror to the mirror lid, and wherein the mirror lid has an area, including the mirror and the surrounding margin, substantially same as an area of the base unit.

Optionally, the half lid is disposed in a range of 2 mm to 6 mm, more optionally at about 4 mm, above an upper plane of the tray to provide the accommodation gap.

Optionally, the mirror lid has a thickness in an order of 3 mm, and wherein the thickness of the mirror lid provides an edge buffer that maintains the mirror lid at an angle in a range of 45° to 85° relative to a plane of the tray, when the mirror lid is in the open state.

Optionally, the base unit has an elongate length, along the first elongate side and the second elongate side, in a range of 12 cm to 20 cm, and a lateral width, orthogonal to the first elongate side and the second elongate side, in a range of 8 cm to 12 cm.

Optionally, a total thickness of the flip-lid mirror cosmetic-product packaging in a range of 1.5 cm to 3.0 cm.

Optionally, the base unit, the mirror lid and the half lid are fabricated from paper or cardboard-containing materials.

Optionally, one or more surfaces of the half lid and the mirror lid have a wipe-clean surface coating.

Optionally, one or more surfaces of the half lid and the mirror lid are provided with a finish onto which graphical images are susceptible to being printed.

In another aspect there is provided a method of (for) manufacturing a flip-lid mirror cosmetic-product packaging, wherein the method includes:

(i) fabricating a base unit including a tray having a plurality of types of cosmetics products disposed spatially in an array on the tray, the base unit having a first elongate side and a second elongate side on mutually opposite sides of the base unit;

(ii) arranging for a half lid to be pivotally attached to the first elongate side with an accommodation gap;

(iii) arranging for a mirror lid to be pivotally attached to an upper edge of the second elongate side, wherein an edge of the mirror lid abuts to the second elongate side, to maintain the mirror lid in a tilted pivotal angle when the mirror lid is in an open state; and (iv) arranging for the mirror lid in its closed state to lie adjacent to the tray, and to be accommodated within the accommodation gap, so that the half lid in its closed state overlays an externally-facing surface of the mirror lid in its closed state.

Optionally, the method further comprises providing a first stud having a first flange with cord or cord loop with an externally-facing surface of the half lid, and providing a second stud having a second flange for receiving the cord or cord loop with the externally-facing surface of the mirror lid to maintain the half lid and the mirror lid secured together when the flip-lid mirror cosmetic-product packaging is to be maintained in a closed state.

Optionally, the flanges of the first and second studs have a diameter in a range of 10 mm to 25 mm.

Optionally, the flanges are secured to the half lid and the mirror lid by employing hollow metallic rivets.

Optionally, the method further comprises providing a permanent magnet arrangement with the half lid and the mirror lid to assist to maintain the half lid retained adjacent to the mirror lid when the flip-lid mirror cosmetic-product packaging is to be maintained in a closed state.

Optionally, the permanent magnet arrangement includes a magnet arranged with the half lid, and wherein the mirror lid, at its external-facing surface, includes a ferrous sheet of metal magnetically attracted to the magnet in the half lid.

Optionally, the method further comprises providing a mirror to an inside surface of the mirror lid with surrounding margin to retain the mirror to the mirror lid, and wherein the mirror lid has an area, including the mirror and the surrounding margin, substantially same as an area of the base unit.

Optionally, the half lid is disposed at about 4 mm above an upper plane of the tray to provide the accommodation gap.

Optionally, the mirror lid has a thickness in an order of 3 mm, and wherein the thickness of the mirror lid provides an edge buffer that maintains the mirror lid at an angle in a range of 45° to 85° relative to a plane of the tray, when the mirror lid is in the open state.

Optionally, the base unit has an elongate length, along the first elongate side and the second elongate side, in a range of 12 cm to 20 cm, and a lateral width, orthogonal to the first elongate side and the second elongate side, in a range of 8 cm to 12 cm.

Optionally, a total thickness of the flip-lid mirror cosmetic-product packaging is in a range of 1.5 cm to 3.0 cm.

Optionally, the base unit, the mirror lid and the half lid are fabricated from paper or cardboard-containing materials.

Optionally, one or more surfaces of the half lid and the mirror lid have a wipe-clean surface coating.

Optionally, one or more surfaces of the half lid and the mirror lid are provided with a finish onto which graphical images are susceptible to being printed.

Additional aspects, advantages, features and objects of the present disclosure would be made apparent from the drawings and the detailed description of the illustrative embodiments construed in conjunction with the appended claims that follow.

It will be appreciated that features of the present disclosure are susceptible to being combined in various combinations without departing from the scope of the present disclosure as defined by the appended claims.

BRIEF DESCRIPTION OF THE DRAWINGS

The summary above, as well as the following detailed description of illustrative embodiments, is better understood when read in conjunction with the appended drawings. For the purpose of illustrating the present disclosure, exemplary constructions of the disclosure are shown in the drawings. However, the present disclosure is not limited to specific methods and instrumentalities disclosed herein. Moreover, those skilled in the art will understand that the drawings are not to scale. Wherever possible, like elements have been indicated by identical numbers.

Embodiments of the present disclosure will now be described, by way of example only, with reference to the following diagrams wherein.

Figure 1:
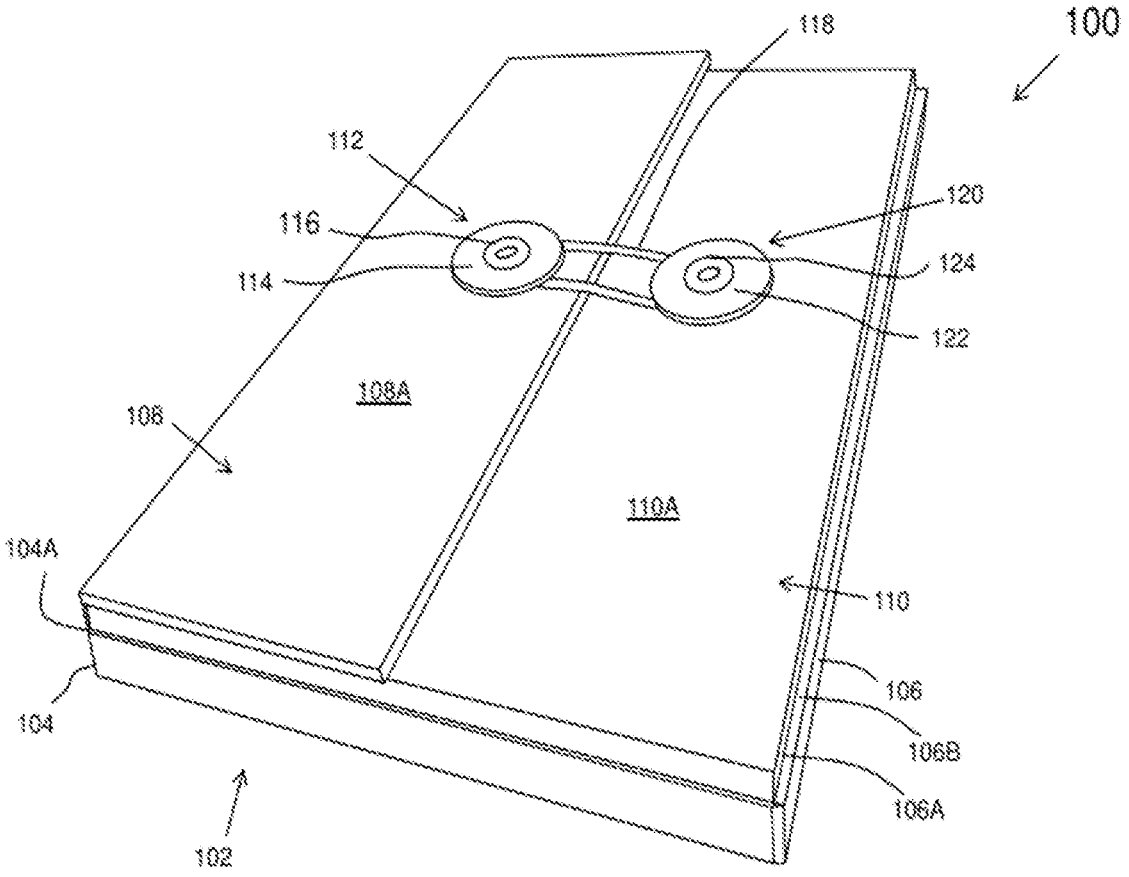
FIG. 1 is an illustration of a perspective view of a flip lid mirror cosmetic-product packaging in a closed state, in accordance with an embodiment of the present disclosure.

In the accompanying drawings, an underlined number is employed to represent an item over which the underlined number is positioned or an item to which the underlined number is adjacent. A non-underlined number relates to an item identified by a line linking the non-underlined number to the item. When a number is non-underlined and accompanied by an associated arrow, the non-underlined number is used to identify a general item at which the arrow is pointing.

DETAILED DESCRIPTION OF EMBODIMENTS

The following detailed description illustrates embodiments of the present disclosure and ways in which they can be implemented. Although some modes of carrying out the present disclosure have been disclosed, those skilled in the art would recognize that other embodiments for carrying out or practising the present disclosure are also possible.

In one aspect, there is provided a flip-lid mirror cosmetic-product packaging, wherein the flip-lid mirror cosmetic-product packaging includes:

(i) a base unit including a tray having a plurality of types of cosmetics products disposed spatially in an array on the tray, the base unit having a first elongate side and a second elongate side on mutually opposite sides of the base unit;

(ii) a half lid that is pivotally attached to the first elongate side with an accommodation gap;

(iii) a mirror lid that is pivotally attached to an upper edge of the second elongate side, wherein an edge of the mirror lid abuts to the second elongate side, to maintain the mirror lid in a tilted pivotal angle when the mirror lid is in an open state; and (iv) the mirror lid in its closed state lies adjacent to the tray, and is accommodated within the accommodation gap, so that the half lid in its closed state overlays an externally-facing surface of the mirror lid in its closed state.

In another aspect there is provided a method of (namely, a method for) manufacturing a flip-lid mirror cosmetic-product packaging, wherein the method includes:

(i) fabricating a base unit including a tray having a plurality of types of cosmetics products disposed spatially in an array on the tray, the base unit having a first elongate side and a second elongate side on mutually opposite sides of the base unit;

(ii) arranging for a half lid to be pivotally attached to the first elongate side with an accommodation gap;

(iii) arranging for a mirror lid to be pivotally attached to an upper edge of the second elongate side, wherein an edge of the mirror lid abuts to the second elongate side, to maintain the mirror lid in a tilted pivotal angle when the mirror lid is in an open state; and (iv) arranging for the mirror lid in its closed state to lie adjacent to the tray, and to be accommodated within the accommodation gap, so that the half lid in its closed state overlays an externally-facing surface of the mirror lid in its closed state.

The present disclosure provides the flip-lid mirror cosmetic-product packaging for storing one or more cosmetic products housed in a tray. The flip-lid mirror cosmetic-product packaging protects the cosmetic products therein during transport, shipping, presentation for sale and provides convenience to customers, eventually. Beneficially, one of the lids (namely, the mirror lid) is provided with a suitably sized mirror so that a user may apply the cosmetic product conveniently, which is an added advantage over the known cosmetics product packaging. Furthermore, the flip-lid mirror cosmetic-product packaging disclosed herein provides sustainable management of resources, as the packaging is reusable and recyclable. The flip-lid mirror cosmetic-product packaging disclosed herein is, durable and user-friendly. It will be appreciated that the flip-lid mirror cosmetic-product packaging in addition to being convenient and user friendly, is also aesthetically appealing to customers.

Throughout the present disclosure the term "cosmetics products" as used herein refers to products employed for enhancing human facial features in an aesthetically pleasing manner. The different types of cosmetic products include, but not limit to, powder-based cosmetics products, gel-based cosmetics products, crème based cosmetic products, water-based cosmetic products and so forth. In an example, cosmetic products include but do not limit to compacts, contours for different skin tones, different shades and textures of blushes, eyeshadows, kohl, lip shades and so forth.

Furthermore, throughout the present disclosure, the term "flip-lid mirror cosmetic-product packaging" refers to an external packaging for the at least one cosmetic product with a mirror for the convenience of application of the at least one cosmetic product. For the sake of simplicity, the term "flip-lid cosmetic-product packaging" may be sometimes referred to as "cosmetic-product" packaging without any limitations. Generally, the at least one cosmetic product is provided to a potential user of the cosmetic product, by a manufacturer of the cosmetic product, by arranging (namely, placing) the at least one cosmetic product within the cosmetic-product packaging for the purpose of transport, presentation for sale and eventual assistance with use of the cosmetic products by users.

It will be appreciated that a shape, size and form of the cosmetic-product packaging is chosen according to a shape, size and form of the one or more cosmetic products arranged therein. Typically, the cosmetic-product packaging has a three-dimensional (3D) geometrical shape, for example, such as a cylindrical shape, a cuboidal shape, a cubical shape, a pentagonal shape, a hexagonal shape, a prism shape, a pyramid shape, a sphere shape, or any other polygonal shape, of varying size and volume depending upon the content (namely, cosmetic product) therein. The cosmetic-product packaging is designed to be opened and closed for accessing, using, and storing the at least one cosmetic product therein.

In addition, the cosmetic-product packaging is fabricated from at least one material, such as a plastics material, a paper-based material, a wood-based material, a glass, a fiber and the like. Moreover, the texture of the at least one material used for fabricating the cosmetic-product packaging can be substantially rough, smooth, or any combination thereof, for example, some portions of the cosmetic-product packaging may be rough, such as for usefully providing a good grip over the cosmetic-product packaging; some portions of the cosmetic-product packaging may be smooth, such that for printing graphics on the exterior of cosmetic-product packaging; and some portions of the cosmetic-product packaging may be a combination of rough and smooth, such that for making the cosmetic-product packaging appear more appealing to the user. For example, by "smooth" is meant a surface undulation of less than 0.05 mm to 0.25 mm, and preferably, 0.08 mm to 0.15 mm. Moreover, by "rough" is meant a surface undulation of more than 0.05 mm to 0.25 mm, and preferably, 0.08 mm to 0.15 mm. In addition, a finish of the cosmetic-product packaging could be uncoated, glossy, matte, and the like.

Beneficially, the cosmetic-product packaging provides protection to the at least one cosmetic product therein. Notably, the cosmetic-product packaging protects the cosmetic product from any damage caused by physical impacts (for example, such as falls, crushing, rough handling, friction with surfaces or other objects, and the like), shocks, knocks and any other accidental factors (such as heat damage, spillage damage, and the like).

Generally, the one or more cosmetic products is placed within the cosmetic product packaging so as to provide protection to the one or more cosmetic products against any damage caused by physical impacts during rough handling, transporting or storing of the product. Generally, the cosmetic-product packaging has a three-dimensional shape such as cuboidal, cubical, hexagonal, pyramidal shape and the like, for example as described in the foregoing. The cosmetics product packaging is designed to be opened and closed for storing and accessing the at least one cosmetic product.

The flip-lid mirror cosmetic-product packaging includes a base unit. The base unit is generally rectangular in shape with a recess into which is conveniently placed the tray with one or more cavities to retain a plurality of types of cosmetics products. Herein, a plurality of types of cosmetics products disposed spatially in an array on the tray. The recess in the base unit is a three-dimensional space which could be of varied shapes. Generally, the shape of the recess in the base unit is same as the shape of the tray. For example, the base unit may be rectangular in shape, while the shape of the tray may be circular, or shaped in the form of a heart, a star and the like. In such case, the shape of the recess is similar to the shape of the tray, such that the tray is conveniently accommodated into the recess. However, in some examples, the shape of the recess can be different from the shape of the tray. For example, the base unit and the recess may be both rectangular in shape and the shape of the tray may be circular, or shaped in the form of a heart, a star and the like without any limitations as long as the tray can be accommodated in the recess. The dimensions of the recess in the base unit are, generally, larger than the dimensions of the tray so that the tray can be conveniently fitted into the recess of the base unit.

Optionally, the base unit can be designed to have more than one recesses with same or different shapes and sizes in order to accommodate more than one tray in the base unit. For example, the base unit may have two recesses. In such case, one of the recesses may be used to accommodate one tray with a plurality of cosmetic products and the other recess may be used to accommodate another tray with brushes/applicators for applying the cosmetic products enclosed in the said one tray.

In the flip-lid mirror cosmetic-product packaging, one of the elongated sides of the base unit is referred to as "first elongate side" and the elongated side mutually opposite to the first elongate side is referred to as "second elongate side". A half lid is pivotally coupled to an upper edge of the first elongate side such that the half lid is disposed a few millimeters above the plane of the tray leaving an accommodation gap. An edge of the half lid which is not coupled to the first elongate side is referred to as "free elongate side" of the half lid. The half lid has two surfaces, namely an internally facing surface that faces towards the tray and an externally facing surface that lies opposite to the internally-facing surface of the half lid. The half lid has an area about half of the area of the base unit such that when placed over the base unit or the tray, the half lid covers only half of the base unit, or the tray placed therein.

Also, a mirror lid is pivotally coupled to an upper edge of the second elongate side of the base unit from one of elongated sides thereof. In particular, an edge of the mirror lid is pivotally connected to the upper edge of the second elongate side such that the mirror lid is maintained at a certain angle when the mirror lid is in an open state. In particular, the edge of the mirror lid abuts to the second elongate side, to maintain the mirror lid in a tilted pivotal angle when the mirror lid is in the open state. Other elongate side of the mirror lid which is not coupled to the second elongate side is referred to as "free elongate side" of the mirror lid. For the sake of simplicity and clarity, "the half lid and the mirror lid" are, sometimes, collectively referred to as the "lids" in the description.

The mirror lid has two surfaces, namely an internally-facing surface that faces towards the tray and an externally-facing surface that lies opposite to the internally-facing surface, when the mirror lid is placed over the tray or the base unit, i.e. when the mirror lid is in a closed state. The mirror lid has an area that is substantially the same area as the area of the base unit such that the mirror lid completely covers the base unit, and the tray therein, in the closed state. When the cosmetic-product packaging is in a closed state, the mirror lid lies adjacent to the tray and to be accommodated within the accommodation gap such that the half lid overlays, i.e. lies above or on top of, the externally-facing surface of the mirror lid in its closed state. The mirror lid serves as a covering for the one or more cosmetic products in the tray. Additionally, the half lid provides partial covering to the mirror lid, thus aiding in the proper closure of the flip-lid mirror cosmetic-product packaging.

According to an embodiment, the mirror lid can be pivotally moved away from the tray or the base unit in the range of 0° to 150° measured in clockwise sense relative to the plane of the tray or the base unit. In one example, the mirror lid can be pivotally moved away from the tray or the base unit in the range of 0° to 120° measured in clockwise sense relative to the plane of the tray or the base unit. Also, the half lid can be pivotally moved away from the externally-facing surface of the mirror lid in the range of 0° to 180° measured in anti-clockwise sense relative to the plane of the tray or the base unit. In one example, the half lid can be pivotally moved away from the externally-facing surface of the mirror lid in the range of 0° to 90° measured in anti-clockwise sense relative to the plane of the tray or the base unit.

According to an embodiment, the base unit has an elongate length, along the first elongate side and the second elongate side, in a range of 12 cm to 20 cm, and a lateral width, orthogonal to the first elongate side and the second elongate side, in a range of 8 cm to 12 cm. In other words, the first elongate side and the second elongate side have lengths in the range of 12 cm to 20 cm. Notably, the half lid and the mirror lid are coupled with the first elongate side and the second elongate side respectively of the base unit. Therefore, the elongate length of the half lid and the mirror lid substantially corresponds to the elongate length of the first elongate side and the second elongate side of the base unit respectively. Thus, the elongate length of the half lid and the mirror lid is also in the range of 12 cm to 20 cm. Furthermore, the mirror lid has a lateral width corresponding to the lateral width of the base unit. Thus, the lateral width of the mirror lid is in the range of 8 cm to 12 cm. Furthermore, the half lid has a lateral width corresponding to about half of the lateral width of the base unit. Thus, the lateral width of the half lid is in the range of 4 cm to 6 cm. Thereby, the overall flip-lid mirror cosmetic-product packaging has an elongate length in the range of 12 cm to 20 cm and lateral width in the range of 8 cm to 12 cm.

In an embodiment, the flip-lid mirror cosmetic-product packaging has a total thickness in a range of 1.5 cm to 3.0 cm, therefore providing a sleek design to the cosmetic-packaging. Such a sleek design makes the cosmetic-product packaging portable and hence the user may carry the cosmetic products enclosed therein to workplace or while travelling with ease and comfort. Optionally, the thickness of the cosmetic-product packaging may vary in the range of 1.0 cm to 5.0 cm.

Optionally, the half lid is disposed at a distance in a range of 2 mm to 6 mm, more optionally about 4 mm above an upper plane of the tray to provide the accommodation gap. Accordingly, the mirror lid has a thickness of about 3 mm such that the mirror lid is conveniently accommodated within the accommodation gap of 4 mm. Notably, the thickness of the mirror lid is less than a width of the accommodation gap so that the mirror lid is conveniently placed within the accommodation gap. Beneficially, the thickness of the mirror lid provides an edge buffer that maintains the mirror lid at an angle in a range of 30° to 90°, more preferably range of ca 45° to ca 85°, relative to a plane of the tray, or surface onto which the cosmetic-product packaging is placed, in the anti-clockwise sense, when the mirror lid is in the open state.

According to an embodiment, the flip-lid mirror cosmetic-product packaging including the half lid, the mirror lid and the tray are fabricated from paper or cardboard containing materials. Notably, the paper or cardboard containing materials are light-weight, easy to handle, and inexpensive. Beneficially, such paper or cardboard containing materials can be easily reused and/or recycled, and therefore are environmentally friendly. Optionally, the packaging can be fabricated using a combination of paper or cardboard containing materials. Optionally, the flip lid mirror cosmetic product packaging can be fabricated using wood, light-weight and recyclable/non-recyclable plastics, biodegradable plastics materials, rubber, biodegradable rubber, and so on.

Optionally, the tray is fabricated from plastics materials which may include, but not limited to, Polyethylene Terephthalate, High-Density Polyethylene, or Polypropylene. Beneficially, such plastics can be recycled and reused, hence making the overall flip-lid mirror cosmetics-product packaging environmentally-friendly.

According to an embodiment, the internally-facing surface of the mirror lid is provided with a mirror with surrounding margin to retain the mirror to the mirror lid; alternatively, the mirror is adhesively bonded to the mirror lid, or a combination of a surrounding margin and adhesive bonding is employed. Optionally, the surrounding margin can be rectangular in shape. The surrounding margin can also be in the form of wave like structures and the like, to make the internally-facing surface of the mirror lid visually appealing. Optionally, the mirror has an area that is substantially the same area as the mirror lid.

Optionally, the size and shape of the mirror can be varied. For example, the mirror can be accommodated in one half of the mirror lid while the other half can be designed to accommodate appropriate size brushes/applicators for the application of one or more cosmetic products provided in the cosmetic-product packaging. In another example, the mirror can be circular in shape, heart-shaped, oval in shape, in the shape of a diamond and the like.

Optionally, the surrounding margin can be provided with one or more light emitting diodes (LEDs) in order to assist the user to apply the one or more cosmetic products conveniently in the dark or low light conditions. Furthermore, optionally, the lids can be provided with a proximity sensor such that the one or more LEDs automatically turn on when the mirror lid is in the open state and turn off when the mirror lid is in the closed state. The power source for the one or more LEDs can be a battery, conveniently concealed in the base unit of the cosmetic-product packaging. For switching ON and OFF, there is optionally employed a combination of a magnet and a magnetic reed switch for connecting the one or more LEDs to the battery, wherein the magnet is included in the mirror lid and the battery and one or more LEDs are included in the base unit, or vice versa.

Optionally, the half lid and the mirror lid when in the closed state completely surround the at least one cosmetic product when the tray is accommodated within the base unit. The tray is designed in a way to accommodate fully the at least one cosmetic product within the recess in the base unit. As a result, the at least one cosmetic product is fully protected within the cosmetic-product packaging.

In an embodiment, the externally facing surface of the half lid is provided with a first stud having a first flange with cord or cord loop attached thereto. The first flange is secured to the half lid by employing a hollow metallic rivet. The cord or cord loop is attached to the hollow metallic rivet. Similarly, the externally-facing surface of the mirror lid is provided with a second stud having a second flange for receiving the cord or cord loop. The second flange is secured to the mirror lid by employing another hollow metallic rivet. The cord or cord loop is retained by the hollow metallic rivet. Such arrangement allows to maintain the half lid and the mirror lid secured together when the flip-lid mirror cosmetic-product packaging is to be maintained in the closed state. The flanges are provided on the lids for the purpose of fastening and unfastening the lids in order to provide required access to the cosmetic products. Thereby, a loose end of the cord or cord loop, that is the end of the cord which is not attached to the first flange, can be wrapped around the second flange to keep the half lid and the mirror lid secured firmly together, when the cosmetic-product packaging is in the closed state.

Hereinafter, for the sake of simplicity and clarity, "the first flange and the second flange" are collectively referred to as the "flanges" throughout the description. The first flange and the second flange are three dimensional structures, optionally circular in shape. The flanges could be optionally polygonal in shape, elliptical in shape, or have an abstract shape or some specific shape such as a heart shape, a crown shape, a cartoon character shape and the like without any limitations.

Optionally, the first flange is disposed substantially midway along the elongate length of the half lid. By "midway" is meant that the location of the first flange is equidistant from lateral sides of the half lid. Furthermore, the first flange is disposed closer to the aforementioned free elongate side of the half lid as compared to the first elongate side. Furthermore, the second flange is disposed at a suitable location on the mirror lid in line with the first flange so as to receive the cord or cord loop therefrom. By "suitable location" is meant that the second flange is equidistant from the lateral sides of the mirror lid and is closer to the second elongate side of the mirror lid.

Optionally, the first flange and the second flange together with the metallic rivets are mutually identical. In such a case, a shape and/or a size of the first flange and the second flange are substantially mutually identical. By "substantially" is meant identical to within +/−20% in physical dimensions, more optionally to within +/−5% in physical dimensions. Alternatively, optionally, the first flange and the second flange together with the hollow metallic rivets are non-identical. In such a case, the shape and/or the size of the first flange and the second flange are mutually different. By "different" is meant more than +/−5% different from each other in physical dimensions, more optionally more than +/−20% different from each other in physical dimensions. Optionally, the flanges of the first and second studs have a diameter in a range of 10 mm to 25 mm.

Optionally, the hollow metallic rivets can be made of brass. Furthermore, the rivets can also me made of other lustrous metals/alloys such as Aluminium, Copper, Iron, Tin, Gold, Lead, Silver, Bronze, steel and the like. The use of such lustrous metals/alloys provides an added visual appeal to the overall packaging.

Notably, the cord or cord loop is an elongate thread-like (or string-like structure) having elasticity properties that allow for the cord or cord loop to be snugly fitted about the flanges for restraining the flanges with respect to each other, as well as to be easily removable for releasing the flanges with respect to each other. Notably, the cord or cord loop is made of a flexible material. In other words, the material used for making the flexible cord is optionally stretchy (namely, capable of being stretched). Examples of such flexible materials include, but are not limited to, neoprene, rubber, linen, Carbon fiber, polypropylene, Nylon®, polyamide and the like.

According to an embodiment, the half lid and the mirror lid are provided with a permanent magnet arrangement to assist to maintain the half lid retained adjacent to the mirror lid, when the flip-lid mirror cosmetic-product packaging is to be maintained in the closed state; optionally, the permanent magnet arrangement is synergistically also used for switching ON and OFF one or more LEDs, as aforementioned. Optionally, the permanent magnet arrangement includes a magnet arranged with the half lid, and the mirror lid includes a ferrous sheet of metal magnetically attracted to the magnet in the half lid. The force of attraction generated by the magnet is sufficient to hold the half lid and the mirror lid together when the flip-lid cosmetic product packaging is in the closed state. Alternatively, the half lid is provided with a ferrous sheet of metal and the mirror lid is provided with a magnet such that the half lid is magnetically attracted to the externally-facing surface of the mirror lid to hold the half lid and the mirror lid together when the flip-lid cosmetic product packaging is in the closed state. Alternatively, the half lid includes a first magnet and the mirror lid includes a second magnet of opposite polarity so as to securely hold the half lid and the mirror lid together by the force of attraction of the two magnets of opposite polarities when the flip lid cosmetic product packaging is in the closed state. The permanent magnet arrangement may prevent the one or more cosmetic products enclosed in the flip-lid mirror cosmetic-product packaging from falling out, and may further reduce risk of contamination of the one or more cosmetic products due to dust particles, smoke, and the like.

In an embodiment, the mirror lid includes a ferrous sheet of metal, the half lid includes a magnet, and the peripheral boundary of the base unit is provided with another magnet. When in the closed state, the mirror lid is magnetically attracted to the peripheral boundary of the base unit. Furthermore, the half lid is magnetically attracted to the externally-facing surface of the mirror lid. Such an arrangement provides an enhanced closure to the flip-lid mirror cosmetic-product packaging.

Optionally, the metal used in the ferrous metal sheet of the mirror lid or the half lid include, but not limit to, metals/alloys like cast Iron, high Carbon steel, mild steel, stainless steel, and the like. Furthermore, the metal sheet used therein can also be a non-ferrous metal with magnetic properties which include, but not limit, to Copper, Brass, Lead and Zinc In an embodiment, one or more surfaces of the half lid and the mirror lid, such as the externally facing surfaces of the half lid and the mirror lid, are provided with a finish onto which graphical images are susceptible to being printed. Additionally, the internally facing surfaces of the half lid and mirror lid are also provided with the finish. Furthermore, the external surfaces of the base unit are provided with the finish. Such a finish could be a glossy finish, a matte finish, and the like. Optionally, one or more surfaces of the half lid and the mirror lid, such as the externally facing surfaces of the half lid and the mirror lid, have a wipe-clean surface coating. Additionally, the internally facing surfaces of the half lid and mirror lid have a wipe-clean surface coating. Furthermore, the external surfaces of the base unit may have a wipe-clean surface coating.

Moreover, appealing graphical images are printed on the external surfaces of the flip-lid mirror cosmetic-product packaging. Notably, printing the graphical images on the one or more surfaces of the cosmetic-product packaging provides an enhanced visual appearance to the cosmetic-product packaging. Furthermore, such graphical images can also be employed to convey information to potential buyers and users of the at least one cosmetic product enclosed within the cosmetic-product packaging; for example, the information pertains to instructions regarding a manner of use of the at least one cosmetic product (for example, allergy information). Examples of such graphic images include, but are not limited to, a brand name of the manufacturer of the at least one cosmetic product, a logo of the manufacturer of the at least one cosmetic product, a shade of the at least one cosmetic product, a collection to which the at least one cosmetic product belongs, a price of the at least one cosmetics product, an expiry date of the at least one cosmetic product, direction of use of the at least one cosmetics product, an image, an abstract design, a pattern, text, and numeric characters. In an example, all outer surfaces of the flip-lid mirror cosmetic-product packaging may be provided with a glossy finish and the brand name of the manufacturer of the at least one cosmetic product and the shade of the at least one cosmetics product may be printed onto such one or more surfaces. Optionally, the graphic images include holograms, prismatic 3D images, thermally-responsive chromic ink patterns, glitter images and so forth.

In an exemplary implementation, when not in operation, that is not in use, the mirror lid is firstly laid down onto the tray, and then the half lid is closed onto to the mirror lid, wherein the aforesaid accommodation gap accommodates a thickness of the mirror lid. The half lid and the mirror lid under the force of magnetic attraction, provide a closure mechanism, partially sealing the one or more cosmetic product contained in the flip lid mirror cosmetic product packaging. Furthermore, the loose end of the aforementioned cord attached to the first flange can be stretched and wrapped around the second flange for securely closing the half lid and the mirror lid in order to maintain the flip-lid mirror cosmetic product packaging in the closed position. In such closed position, the at least one cosmetic product is prevented from falling out of the flip-lid mirror cosmetic-product packaging.

Furthermore, when the one or more cosmetic products are to be accessed, the flip lid mirror cosmetic product packaging is disposed into the open position. For opening the lids, the aforementioned loose end of the cord can be stretched in a manner such that the loose end is no longer restrained by the second flange. Furthermore, a minimal amount of pressure is to be applied against the force of attraction of the permanent magnet arrangement in order to separate the internally facing surface of the half lid from the externally-facing surface of the mirror lid. Once separated, the half lid can be moved pivotally away from the base unit and subsequently the mirror lid can be moved pivotally away from the half lid, such that the tray is accessible to the user. The mirror lid can be pivotally moved within a range of 0° to 150° measured in clockwise sense relative to the plane of the base unit or the tray. In other words, the mirror lid has a range of 30° to 180° measured in anti-clockwise sense relative to the surface onto which the flip-lid mirror cosmetic-product packaging is placed. Notably, at an angle of 180° in anti-clockwise sense relative to the plane of the surface, the mirror lid is in the closed state. Furthermore, the mirror lid can be preferably maintained at an angle in the range of 30° to 60° measured in anti-clockwise sense relative to the plane of the tray when in the open state due to the edge of the mirror lid abutting to the second elongate side, to maintain the mirror lid in the tilted pivotal angle, ready for use during personal beautification activities.

The present disclosure also relates to the method as described above. Various embodiments and variants disclosed above apply mutatis mutandis to the method.

Optionally, the method further comprises providing a first stud having a first flange with cord or cord loop with an externally-facing surface of the half lid, and providing a second stud having a second flange for receiving the cord or cord loop with the externally-facing surface of the mirror lid to maintain the half lid and the mirror lid secured together when the flip-lid mirror cosmetic-product packaging is to be maintained in a closed state.

Optionally, the flanges of the first and second studs have a diameter in a range of 10 mm to 25 mm.

Optionally, the flanges are secured to the half lid and the mirror lid by employing hollow metallic rivets.

Optionally, the method further comprises providing a permanent magnet arrangement with the half lid and the mirror lid to assist to maintain the half lid retained adjacent to the mirror lid when the flip-lid mirror cosmetic-product packaging is to be maintained in a closed state.

Optionally, the permanent magnet arrangement includes a magnet arranged with the half lid, and wherein the mirror lid, at its external-facing surface, includes a ferrous sheet of metal magnetically attracted to the magnet in the half lid.

Optionally, the method further comprises providing a mirror to an inside surface of the mirror lid with surrounding margin to retain the mirror to the mirror lid, and wherein the mirror lid has an area, including the mirror and the surrounding margin, substantially same as an area of the base unit.

Optionally, the half lid is disposed at about 4 mm above an upper plane of the tray to provide the accommodation gap.

Optionally, the mirror lid has a thickness in an order of 3 mm, and wherein the thickness of the mirror lid provides an edge buffer that maintains the mirror lid at an angle in a range of ca 45° to ca 85° relative to a plane of the tray, when the mirror lid is in the open state.

Optionally, the base unit has an elongate length, along the first elongate side and the second elongate side, in a range of 12 cm to 20 cm, and a lateral width, orthogonal to the first elongate side and the second elongate side, in a range of 8 cm to 12 cm.

Optionally, a total thickness of the flip-lid mirror cosmetic-product packaging is in a range of 1.5 cm to 3.0 cm.

Optionally, a total thickness of the second elongate side is in a range of 2 mm to 5 mm, more preferably in a range of 2 mm to 4 mm.

Optionally, the base unit, the mirror lid and the half lid are fabricated from paper or cardboard-containing materials.

Optionally, one or more surfaces of the half lid and the mirror lid have a wipe-clean surface coating.

Optionally, one or more surfaces of the half lid and the mirror lid are provided with a finish onto which graphical images are susceptible to being printed.

DETAILED DESCRIPTION OF DRAWINGS

Figure 2:
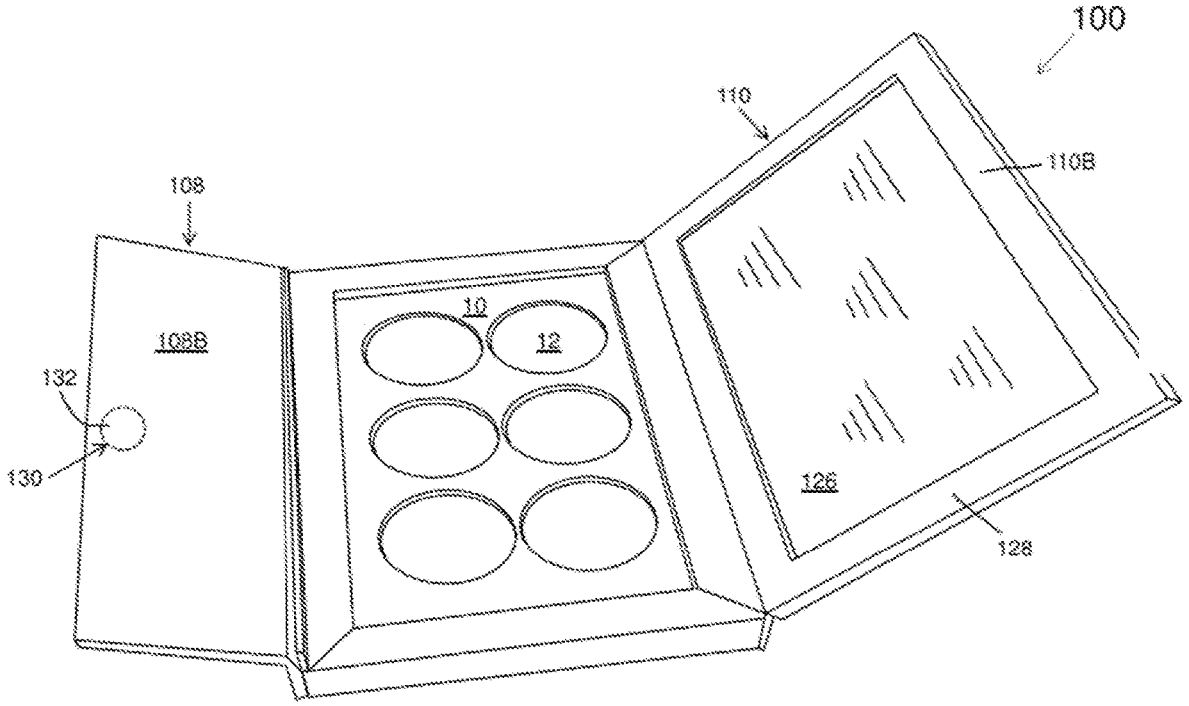
FIG. 2 is an illustration of a top perspective view of a flip lid mirror cosmetic-product packaging in an open state in accordance with an embodiment of the present disclosure.

Referring to FIGS. 1 to 2 in combination, there are illustrated perspective views of a flip lid mirror cosmetic-product packaging 100 in a closed state and an open state respectively, in accordance with an embodiment of the present disclosure. As illustrated, the flip lid mirror cosmetic-product packaging 100 includes a base unit 102. The base unit 102 includes a tray 10 having a plurality of types of cosmetics products 12 disposed spatially in an array on the tray 10 (as shown in FIG. 2). The base unit 102 has a first elongate side 104 and a second elongate side 106 on mutually opposite sides thereof. Optionally, the array is a spatially regular array; alternatively, the array is implemented in a pseudo-random manner.

The flip lid mirror cosmetic-product packaging 100 includes a half lid 108 that is pivotally attached to an upper edge 104A of the first elongate side 104 with an accommodation gap (such as accommodation gap 109, shown in FIG. 3) formed between the half lid 108 and the tray 10. The half lid 108 has an externally-facing surface 108A and an internally facing surface 108B. The flip lid mirror cosmetic-product packaging 100 also includes a mirror lid 110 that is pivotally attached to an upper edge 106A of the second elongate side 106. When the mirror lid 110 is in an open position at an angle of a range of ca 30° to ca 90°, more preferably a range of ca 45° to ca 85°, the mirror lid 110 abuts/rests on the upper surface 106B of the second elongate side 106. This allows the mirror lid 110 to be in a good position for anyone applying makeup from the cosmetic-product packaging 100. In one preferred embodiment, the second elongated side 106 is wider than the first elongated side 104 to allow a more rigid resting of the mirror lid 110 when in the open position. The mirror lid 110 has an externally-facing surface 110A and an internally facing surface 1108. The mirror lid 110 in its closed state lies adjacent to the tray 10, and is accommodated within the accommodation gap 109, so that the half lid 108 in its closed state overlays the externally-facing surface 110A of the mirror lid 110 in its closed state.

The externally-facing surface 108A of the half lid 108 is provided with a first stud 112 having a first flange 114 secured to the externally-facing surface 108A by a hollow metallic rivet 116, and with a cord or cord loop 118 attached thereto. The externally-facing surface 110A of the mirror lid 110 is provided with a second stud 120 having a second flange 122 secured to the externally-facing surface 110A by another hollow metallic rivet 124, and with the cord or cord loop 118 retained thereby, when the flip lid mirror cosmetic-product packaging 100 is in the closed state.

Figure 4:
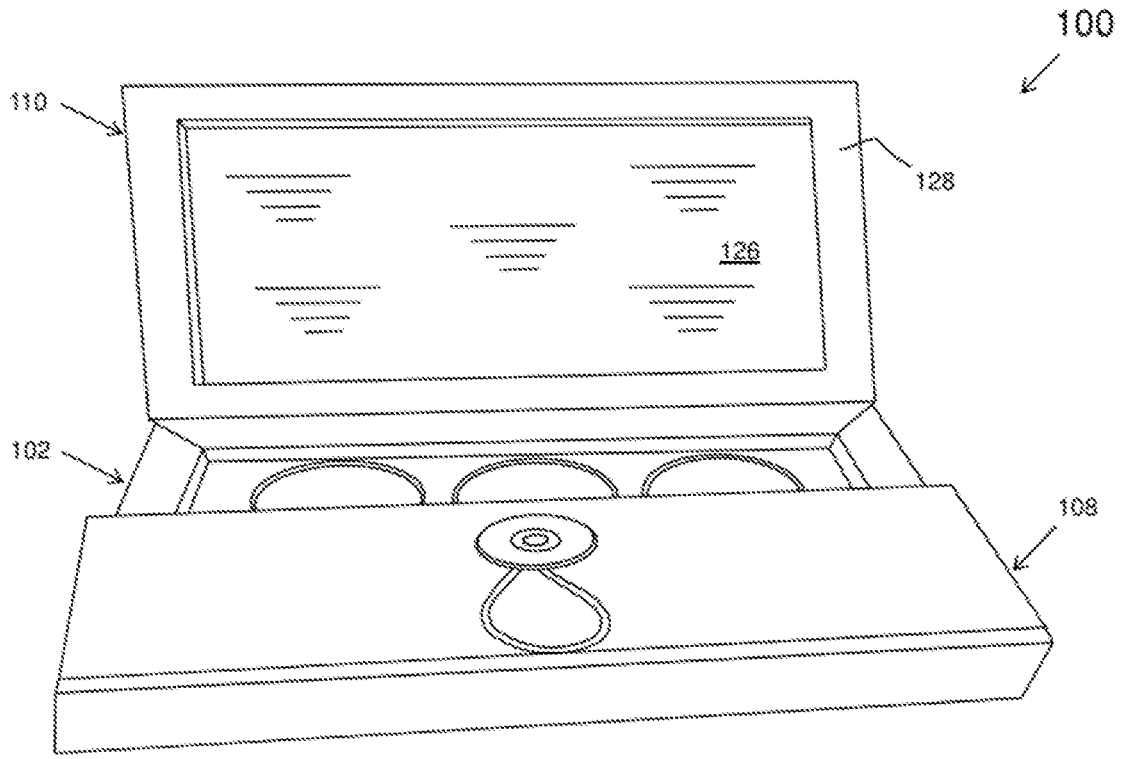
FIG. 4 is an illustration of a front perspective view of a flip lid mirror cosmetic-product packaging in an open state in accordance with an embodiment of the present disclosure.

Furthermore, an inside surface, or the internally facing surface 1108, of the mirror lid 110 is provided with a mirror 126 with surrounding margin 128 to retain the mirror 120 to the mirror lid 110 (as more clearly illustrated in FIG. 4).

Further, the half lid 108 and the mirror lid 110 are provided with a permanent magnet arrangement 130 to assist to maintain the half lid 108 retained adjacent to the mirror lid 110, when the flip-lid mirror cosmetic-product packaging 100 is to be maintained in the closed state. The permanent magnet arrangement 130 includes a magnet 132 arranged with the half lid 108 (as illustrated in FIG. 2), and the mirror lid 110 includes a ferrous sheet of metal 134 magnetically attracted to the magnet in the half lid 108.

Figure 3:
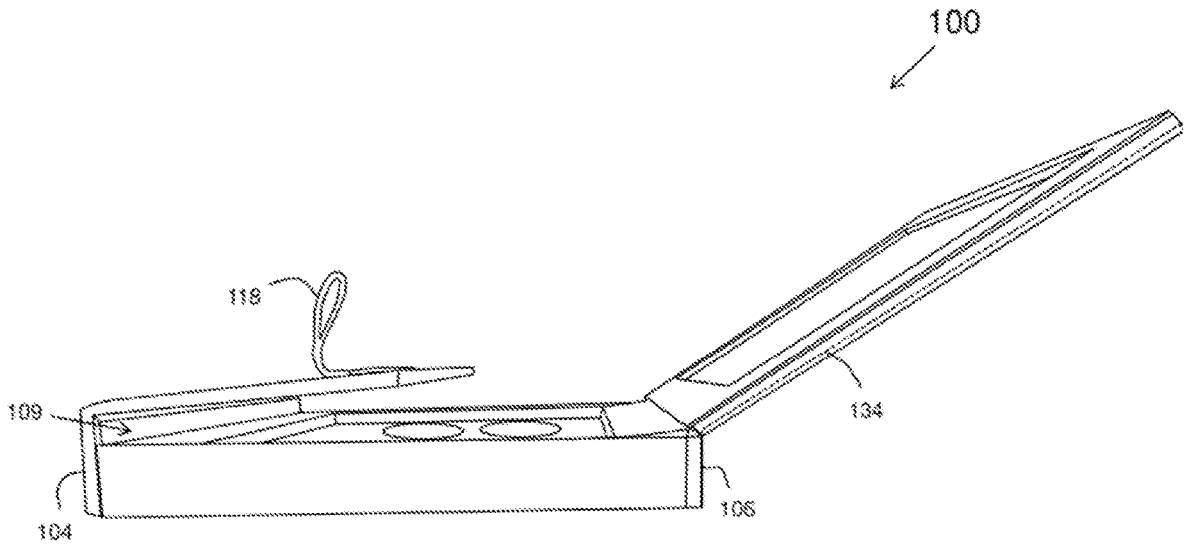
FIG. 3 is an illustration of a side perspective view of a flip lid mirror cosmetic-product packaging in an open state in accordance with an embodiment of the present disclosure.

Referring to FIG. 3, illustrated is a side perspective view of a flip lid mirror cosmetic-product packaging in a partly open state 300, in accordance with an embodiment of the present disclosure. Herein, the half lid 108 is in its closed state and the mirror lid 110 is in its open state. It should also be noted that the half lid 108 is pivotally attached to the first elongate side 104 with the accommodation gap 109 formed between the half lid 108 and the tray 10.

Figure 5:
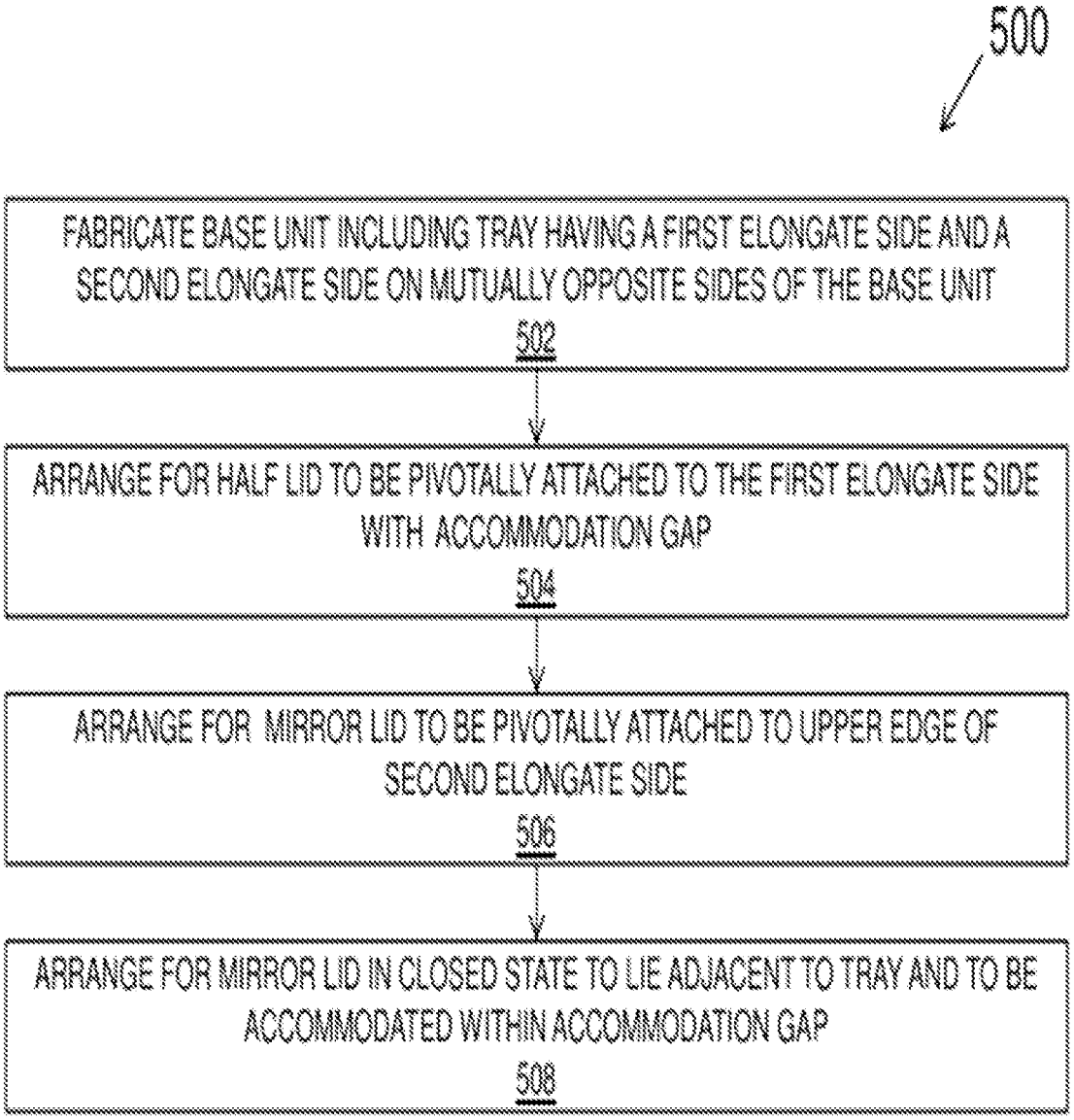
FIG. 5 is an illustration of steps of a method for manufacturing a flip-lid mirror cosmetic-product packaging in accordance with an embodiment of the present disclosure.

Referring to FIG. 5, there are illustrated therein steps of a method 500 for (namely, a method of) manufacturing a flip-lid mirror cosmetic-product packaging, in accordance with an embodiment of the present disclosure.

At a step 502, the base unit including the tray having a plurality of types of cosmetics products disposed spatially in an array on the tray is fabricated such that the base unit has a first elongate side and a second elongate side on mutually opposite sides thereof.

At a step 504, the half lid is arranged to be pivotally attached to the first elongate side with the accommodation gap.

At a step 506, a mirror lid is arranged to be pivotally attached to the upper edge of the second elongate side such that an edge of the mirror lid abuts to the second elongate side to maintain the mirror lid in a tilted pivotal angle when the mirror lid is in the open state.

At a step 508, the mirror lid is arranged in its closed state to lie adjacent to the tray, and is accommodated within the accommodation gap, so that the half lid in its closed state overlays the externally-facing surface of the mirror lid in its closed state.

The steps 502 to 508 are only illustrative and other alternatives can also be provided where one or more steps are added, one or more steps are removed, or one or more steps are provided in a different sequence without departing from the scope of the claims herein.

Modifications to embodiments of the present disclosure described in the foregoing are possible without departing from the scope of the present disclosure as defined by the accompanying claims. Expressions such as "including", "comprising", "incorporating", "have", "is" used to describe and claim the present disclosure are intended to be construed in a non-exclusive manner, namely allowing for items, components or elements not explicitly described also to be present. Reference to the singular is also to be construed to relate to the plural.

The invention claimed is:

1. A flip-lid mirror cosmetic-product packaging, wherein the flip-lid mirror cosmetic-product packaging includes:

(i) a base unit including a tray having a plurality of types of cosmetics products disposed spatially in an array on the tray, the base unit having a first elongate side and a second elongate side on mutually opposite sides of the base unit;

(ii) a half lid that is pivotally attached to the first elongate side with an accommodation gap, wherein an area of the half lid is about half of an area of the base unit;

(iii) a mirror lid that is pivotally attached to an upper edge of the second elongate side, wherein an edge of the mirror lid abuts the second elongate side, to maintain the mirror lid in a tilted pivotal angle when the mirror lid is in an open state, wherein an area of mirror lid is substantially the same as the area of the base unit, wherein an internally-facing surface of the mirror lid is provided with a mirror with surrounding margin to retain the mirror to the mirror lid, wherein the a surrounding margin is provided with at least one light emitting diode, wherein the mirror lid is provided with a proximity sensor, and wherein the base unit is provided with a battery to provide power to the at least one light emitting diode; and (iv) the mirror lid in its closed state lies adjacent to the tray, and is accommodated within the accommodation gap, so that the half lid in its closed state overlays an externally-facing surface of the mirror lid in its closed state, and wherein an externally-facing surface of the half lid is provided with a first stud having a first flange with a cord or cord loop attached thereto, and the externally-facing surface of the mirror lid is provided with a second stud having a second flange for receiving the cord or cord loop to maintain the half lid and the mirror lid secured together when the flip-lid mirror cosmetic-product packaging is to be maintained in a closed state.

2. The flip-lid mirror cosmetic-product packaging of claim 1, wherein the first flange of the first stud and the second flange of the second stud have a diameter in a range of 10 mm to 25 mm.

3. The flip-lid mirror cosmetic-product packaging of claim 1, wherein the half lid and the mirror lid are provided with a permanent magnet arrangement to assist to maintain the half lid retained adjacent to the mirror lid when the flip-lid mirror cosmetic-product packaging is to be maintained in the closed state.

4. The flip-lid mirror cosmetic-product packaging of claim 3, wherein the permanent magnet arrangement includes a magnet arranged with the half lid, and wherein the mirror lid includes a ferrous sheet of metal magnetically attracted to the magnet in the half lid.

5. The flip-lid mirror cosmetic-product packaging of claim 1, wherein the mirror lid has an area, including the mirror and the surrounding margin, substantially same as an area of the base unit and wherein the mirror lid has a thickness below 4 mm.

6. The flip-lid mirror cosmetic-product packaging of claim 1, wherein the half lid is disposed at about 4 mm above an upper plane of the tray to provide the accommodation gap.

7. The flip-lid mirror cosmetic-product packaging of claim 1, wherein the pivotal angle of the mirror lid is within a range of 45° to 85°, relative to a plane of the tray.

8. The flip-lid mirror cosmetic-product packaging of claim 1, wherein the base unit has an elongate length, along the first elongate side and the second elongate side, in a range of 12 cm to 20 cm, and a lateral width, orthogonal to the first elongate side and the second elongate side, in a range of 8 cm to 12 cm.

9. The flip-lid mirror cosmetic-product packaging of claim 1, wherein a total thickness of the flip-lid mirror cosmetic-product packaging in a range of 1.5 cm to 3.0 cm.

10. The flip-lid mirror cosmetic-product packaging of claim 1, wherein the base unit, the mirror lid and the half lid are fabricated from paper or cardboard-containing materials.

11. The flip-lid mirror cosmetic-product packaging of claim 1, wherein one or more surfaces of the half lid and the mirror lid have a wipe-clean surface coating.

* * * * *